US006627862B1

(12) United States Patent
Pedersen

(10) Patent No.: US 6,627,862 B1
(45) Date of Patent: Sep. 30, 2003

(54) PACKING ARTICLE, PARTICULARLY FOR PRE-BAKED AND FROZEN DOUGH PRODUCTS

(75) Inventor: Steen Pedersen, Esbjerg (DK)

(73) Assignee: Trykko Pack A/S, Esbjerg (DK)

( * ) Notice: Subject to any disclaimer, the term of this patent is extended or adjusted under 35 U.S.C. 154(b) by 0 days.

(21) Appl. No.: 09/857,327

(22) PCT Filed: Sep. 15, 1999

(86) PCT No.: PCT/DK99/00487

§ 371 (c)(1),
(2), (4) Date: Jul. 5, 2001

(87) PCT Pub. No.: WO00/35770

PCT Pub. Date: Jun. 22, 2000

(30) Foreign Application Priority Data

Dec. 2, 1998 (DK) ..... 1998 00450 U

(51) Int. Cl.[7] ..... H05B 6/80

(52) U.S. Cl. ..... 219/730; 219/734; 219/732; 426/234; 426/118; 99/DIG. 14

(58) Field of Search ..... 219/730, 759, 219/725, 734, 735, 762, 732; 426/107, 113, 118, 234, 241; 99/DIG. 14

(56) References Cited

U.S. PATENT DOCUMENTS 4,505,391 A * 3/1985 Kuchenbecker ..... 219/732
4,745,249 A * 5/1988 Daniels ..... 219/734
4,870,233 A * 9/1989 McDonald et al. ..... 219/730
4,877,932 A * 10/1989 Bernstein et al. ..... 219/730
4,896,009 A 1/1990 Pawlowski ..... 219/730
5,223,685 A * 6/1993 Derienzo, Jr. ..... 219/732
5,310,977 A * 5/1994 Stenkamp et al. ..... 219/730
5,391,864 A 2/1995 Bodor et al. ..... 219/730
5,484,984 A * 1/1996 Gics ..... 219/734
5,585,027 A 12/1996 Young ..... 219/730
5,680,956 A 10/1997 Woodward et al. ..... 220/607
6,137,099 A * 10/2000 Hamblin ..... 219/730

FOREIGN PATENT DOCUMENTS

SE 7705682 1/1986 ..... B65D/81/34
WO 9219515 11/1992 ..... B65D/81/34
WO 9808752 3/1998 ..... B65D/81/34

* cited by examiner

*Primary Examiner*—Philip H. Leung
(74) *Attorney, Agent, or Firm*—Antonelli, Terry, Stout & Kraus, LLP

(57) ABSTRACT

There is described a packing item (2), especially for prebaked and/or frozen dough items, e.g. pizzas, calzones, and pies, which packing item (2) at the side facing the dough item is provided with a so-called susceptor coating, for example consisting of a polyester coated, patterned metallizing or metal coating where a bottom part (4) of the packing item (2) is designed with a number of ventilation openings (8) around a central area (10).

19 Claims, 6 Drawing Sheets

PACKING ARTICLE, PARTICULARLY FOR PRE-BAKED AND FROZEN DOUGH PRODUCTS

The present invention concerns a packing item, especially for prebaked and frozen dough items.

Packing items are known in many shapes and for many specific purposes. For use for overbaked and frozen dough items, e.g. pizzas, calzones and pies, intended for cooking in microwave ovens, there are known, for example tray or plate shaped packing items which preferably internally are provided with a special microwave reflecting, metallic coating. These specially coated packing items for use in microwave ovens are named "microwave susceptor articles" in the subject field. In order to avoid excessive heating and burning of the dough item there are further known "safety susceptors" where the microwave reflecting coating is not provided with the reflective coating at least in punctiform patterns or in part areas. It that connection it should be mentioned that the reflective coating only has the desired effect if the dough item is in contact with the reflective coating.

Nevertheless, especially in central parts of e.g. pizzas, problems may arise with uneven baking or heating, i.e. that there may occur overheated and burned areas or zones which are wet and unbaked. Therefore, such wet, unbaked zones within the central area or overheated areas at the outer areas (edges) have only been avoided in practice by making relatively small pizzas.

U.S. Pat. No. 5,585,027 discloses a microwave susceptive reheating support with perforations enabling change of size and/or shape of the substrate. For example, a round substrate may be provided with a circular pattern of tear perforations spaced radially inward from an outer circumference of the round substrate enabling to adjust the size of the substrate by removing the outer ring-shaped part of the substrate for use with smaller sized food products. The pattern of tear perforations may include one or more lines of tear perforations that extend across the substrate so that this may be divided into more parts, by way of example, to heat a slice of pizza instead of the entire pizza.

U.S. Pat. No. 4,896,009 discloses a gas permeable microwave reactive package having a flat substrate and a microwave reactive layer affixed over one surface of the substrate having at least one aperture allowing gases and vapors generated from cooking foods such as large pie crusts to traverse the laminate thereby allowing the foods products to remain in close proximity to the heater resulting in improved browning and crisping.

SUMMARY OF THE INVENTION

The invention is an improved packing item by which the drawbacks of the prior art are remedied by means of simple provisions.

The packing item according to the invention is provided with a number of ventilation openings. By means of simple provisions there is hereby achieved a new and improved packing item, where the disadvantages with overheated or unbaked zones by corresponding, known packing items are remedied. In that connection it should be mentioned that the outer shape of the packing item according to the invention may be circular, oval, elliptical, quadratic, rectangular, or have another shape, according to wish and need.

Normally, the height of the packing item according to the invention for use for overbaked or frozen dough items like pizzas, calzones and pies is negligible or rather small. But, for example, for use for larger frozen dough items like white bread for baking in the microwave oven, the packing item may have greater height, which is why at least the lower part of the side walls with perforations (ventilation openings) of such a higher packing item may possibly also be designed in this way.

With the purpose of ensuring good access to the ventilation openings at the bottom, the packing item according to the invention may thus be designed so that the bottom surface in punctiform support zones has greater thickness or depth so that the greater part of the bottom of the packing item including the central area may be lifted free of a support surface.

For adjusting in a simple way the effect of the susceptor coating as well as the effect of the ventilation openings and for covering the dough item, it may furthermore be an advantage that the packing item according to the invention is thus designed so that the ventilation openings at the bottom side of the packing item are covered by means of one or more detachable labels which at the side facing upwards toward the underside of the plate or tray are, for example, provided with a susceptor coating, as the primary function of the labels is covering the dough item downward so that the packing item only has to be provided with, for example, a transparent lid as proper sales packing.

Suitably, the packing item according to the invention is further thus designed so that the item along the periphery or the outer edge has an annular, narrow zone with greater thickness or depth, i.e. so that the greater part of the bottom of the packing item including the central area is situated at a slightly higher level than the annular zone, and that said annular, outer zone is provided with radial ventilation grooves.

A packing item according to the invention and designed as a circular tray-shaped packing item for a pizza or similar dough item and being adapted to be divided into a number of packing items by means of radial perforations is in a circular central area provided with downward bent edge parts arranged to constitute "feet" for pointed end parts of the divided packing items.

A packing item according to the invention and designed as a circular packing item for a pizza or a similar dough item, which packing item is made of a packing item which in a plane state has a wavy outer edge, and which in the upward bent state has feet downward along the periphery, has feet formed by wave crests of the outer edge, and has radial ventilation openings formed by vales of the outer edge.

A packing item according to the invention and designed as a circular packing item for a pizza or similar dough item, which packing item is designed with an outer annular support surface, and has a support or bottom surface designed and located so that there is a distance of about 3–20 mm between the support or bottom surface and the support surface which is designed with radial ventilation openings.

BRIEF DESCRIPTION OF THE DRAWINGS

The invention is explained in more detail in the following with reference to the drawing, on which.

DESCRIPTION OF THE PREFERRED EMBODIMENTS

Figure 1:
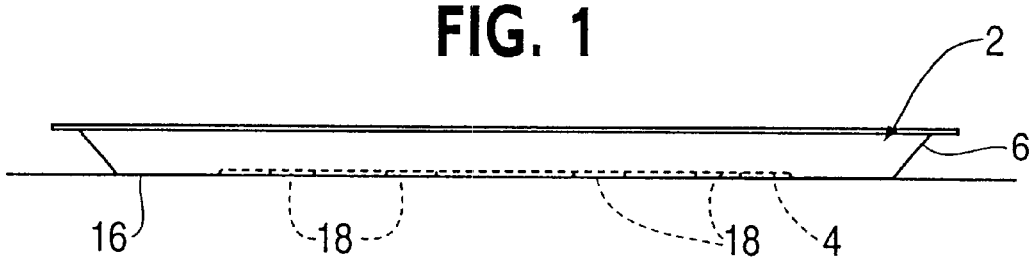
FIG. 1 shows An elevational view through an embodiment of a packing item according to the invention.
Figure 2:
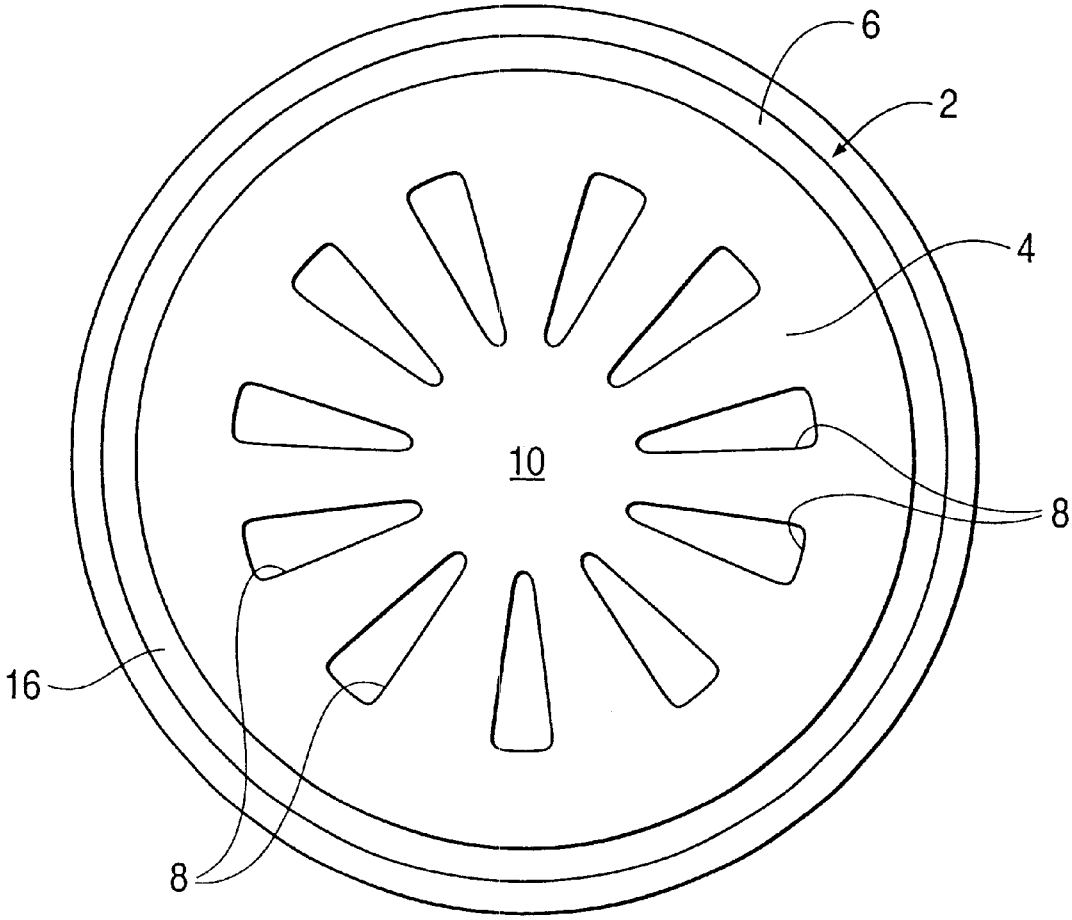
FIG. 2 shows a plane view of an embodiment of a packing item according to the invention.
Figure 3:
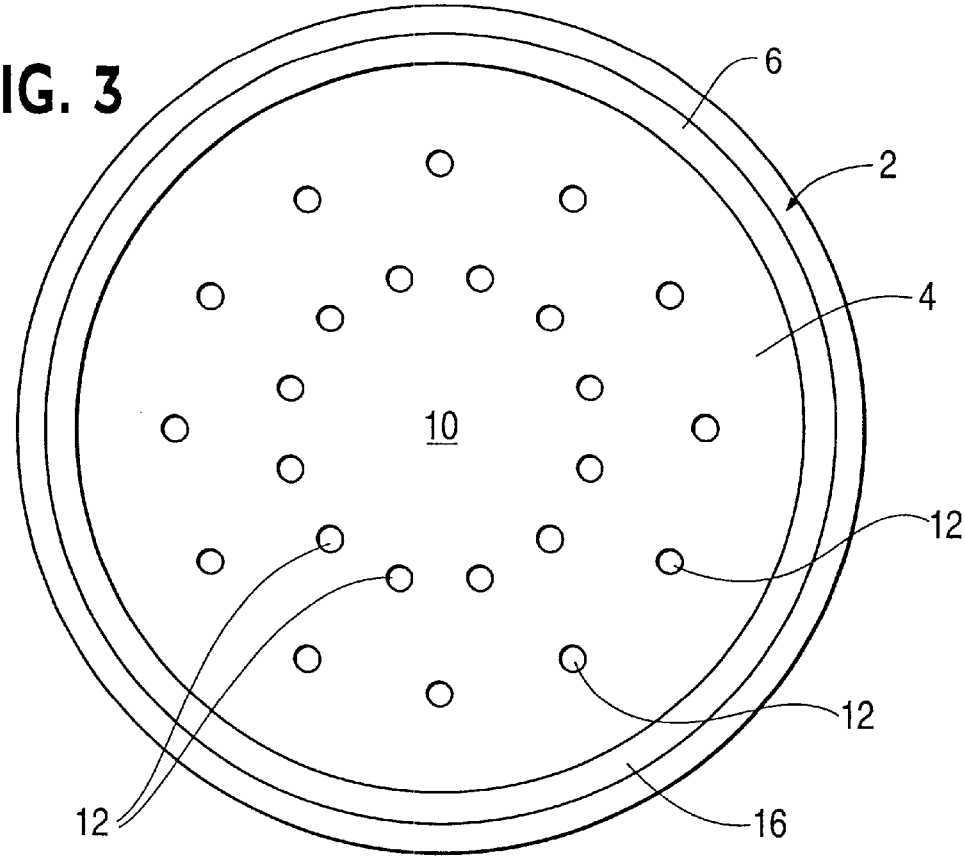
FIG. 3 shows a plane view of a second embodiment of a packing item according to the invention.
Figure 4:
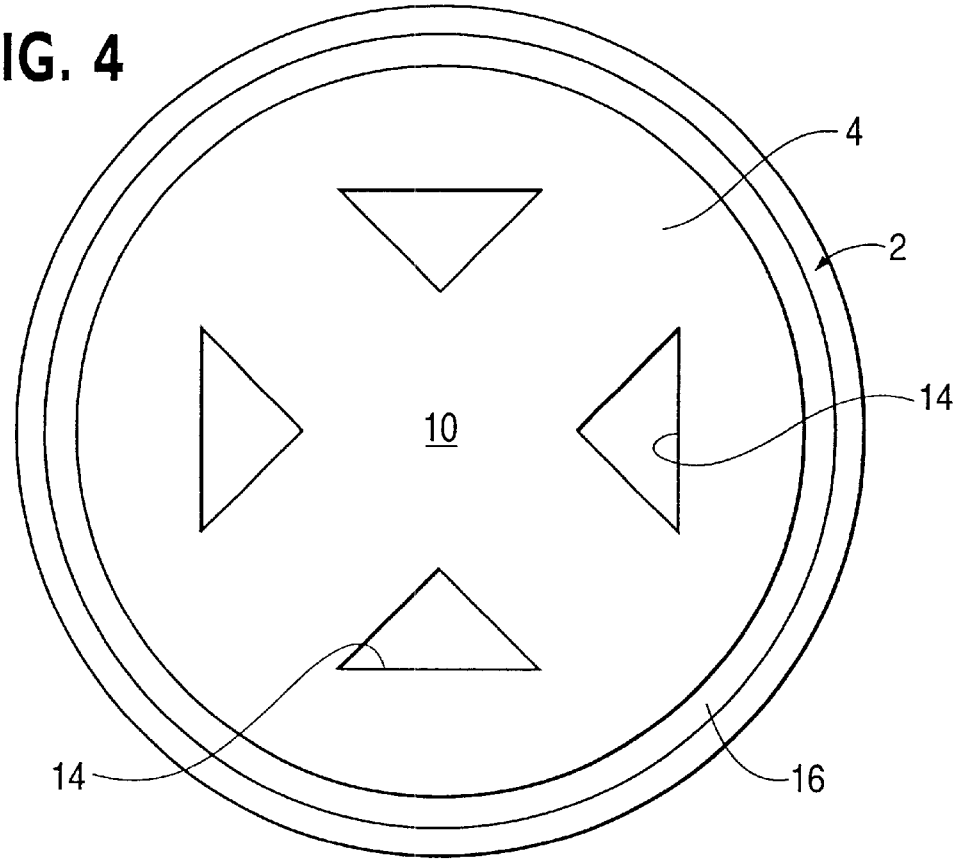
FIG. 4 shows a plane view of a third embodiment of a packing item according to the invention.

The packing item 2 shown in FIG. 1 is made of cardboard, plastic or a suitable packing material (including e.g. a starch material) with a surface coating in the shape of a susceptor coating e.g. consisting of a polyester film provided with a possible patterned metal coating. The packing item 2 comprises a bottom part 4 and enclosing, sloping side walls 6 since the packing item 2 is intended for pizza or pie baked in a microwave oven. The bottom part 4 of the packing item 2 is, as shown in FIG. 2, outside a central area 10 designed with mainly triangular ventilation openings 8. Alternatively, the bottom part 4, as shown in FIG. 3, may be designed with a large number of lesser ventilation openings 12 outside the central area 10 arranged in concentric, annular zones. Or the bottom part may, as shown in FIG. 4, be designed with rather few larger, triangular ventilation openings 14.

As also seen in FIG. 1, the packing item 2 has an outer annular edge 16 with greater depth so that the bottom part 4 separated from a support surface. The annular edge 16 may preferably be designed in a way (not shown) with radial ventilation grooves 18 so that connection is made to the ventilation openings 8, 12 or 14.

Figure 11:
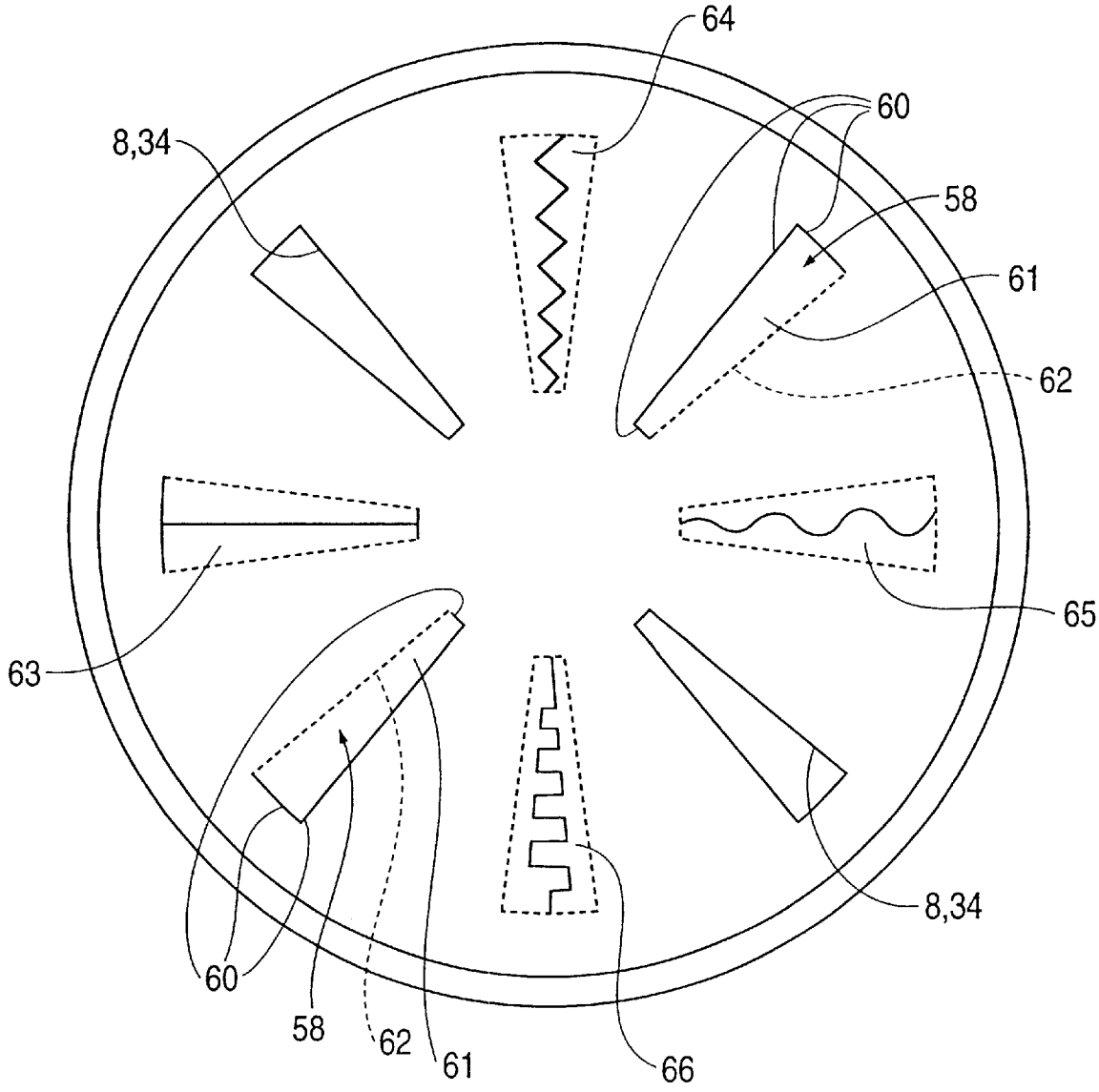
FIG. 11 shows a plane view for illustrating different ways of making ventilation openings in the bottom part of a packing item according to the invention.

Finally, it is within the scope of the invention to provide the central area 10 of the bottom part 4 of the packing item 2 with a number of ventilation openings. Likewise, the support zones in the bottom surface may be formed by downward bent edges of the ventilation openings (FIG. 11).

Figure 5:
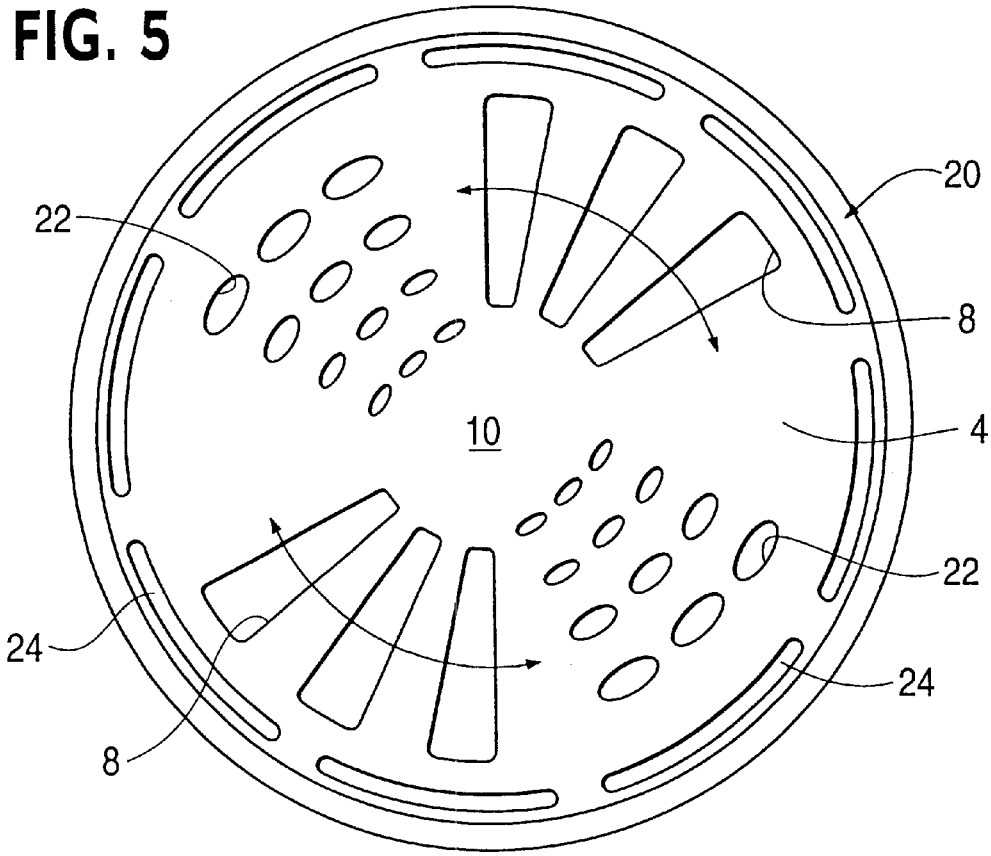
FIG. 5 shows a plane view of a packing item according to the invention on which different kinds of ventilation opening are illustrated.

The bottom part 4 of a packing item 20 according to the invention may, as illustrated in FIG. 5, be provided with several different kinds of ventilation openings, namely triangular ventilation openings 8 with radially outward increasing width, groups of circular or elliptical ventilation openings 22 or a number of narrow concentric ventilation openings 24 along the marginal zone of the packing item as the central area 10 is kept free from ventilation openings.

Figure 7:
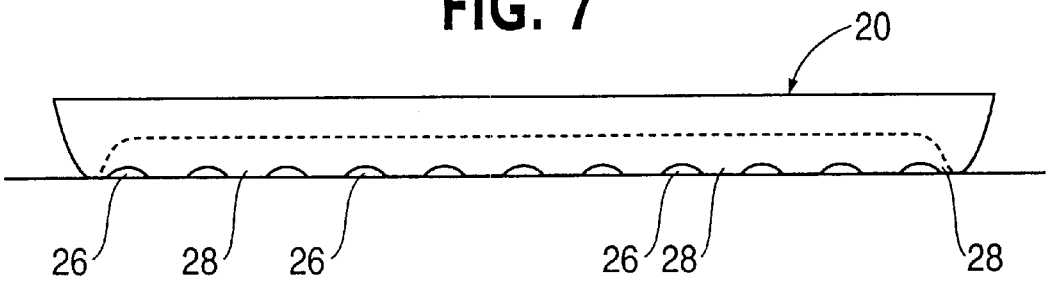
FIG. 7 shows a side elevational view through the packing item shown in FIG. 5 according to the invention.

Further, as appears in FIG. 7, the packing item 20 is designed with radial ventilation openings 26 and feet 28, respectively, in an outer annular support zone.

Figure 6:
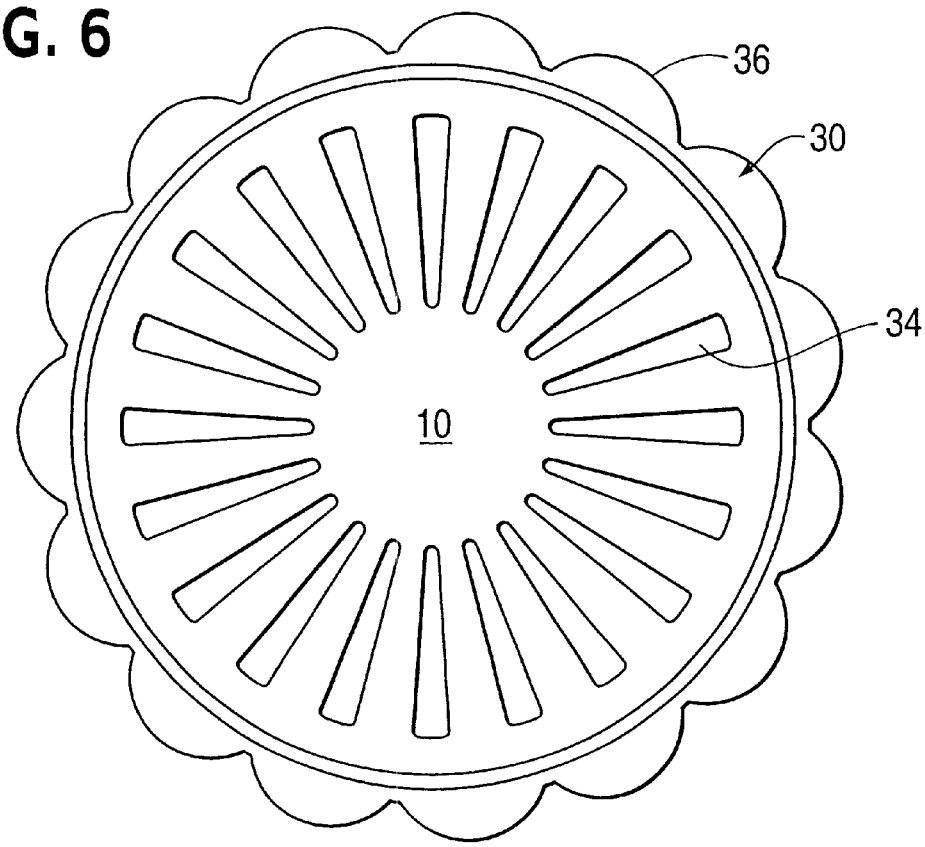
FIG. 6 shows a plane view of a fourth embodiment of a packing item according to the invention.
Figure 8:
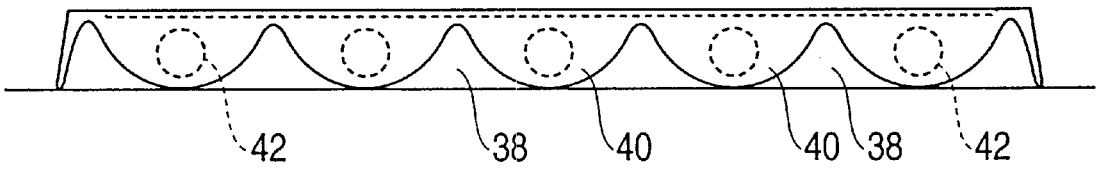
FIG. 8 shows a side elevational view through the packing item shown in FIG. 6 according to the invention.

The plane packing item shown in FIG. 6 has a bottom surface designed with a large number of radial ventilation openings 34 around a central area 10. The outer edge outline 36 of the packing item 30 has wavy shape so that the finished packing item 30, as shown in FIG. 8, thereby gets radial ventilation openings 38 between feet 40 formed by the "wave crests". Alternatively, the packing item 30 could be designed according to the same principle, but with a circular edge outline. In that case, the packing item 30 may be designed with radial ventilation openings 42 in the annular support skirt.

Figure 9:
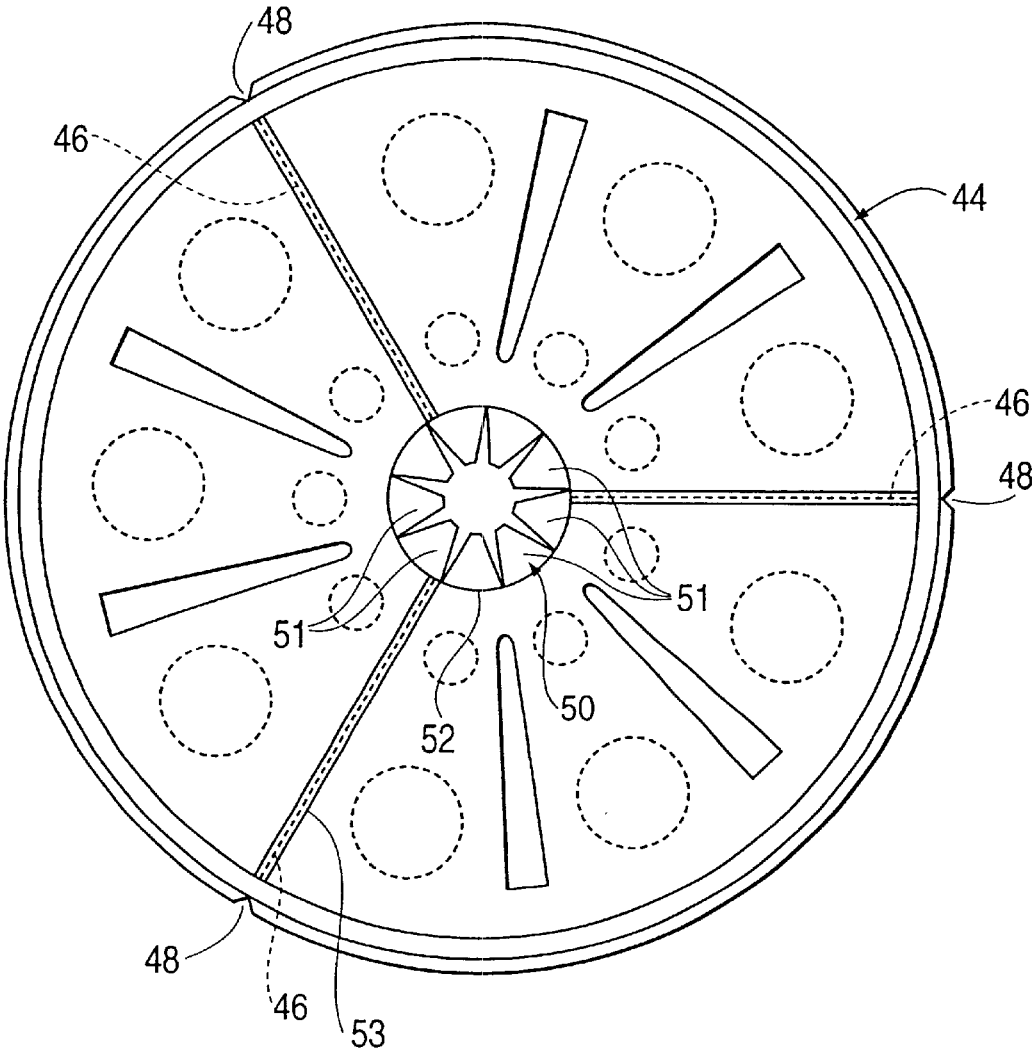
FIG. 9 shows a plane view of a fifth embodiment of a packing item according to the invention.
Figure 10:
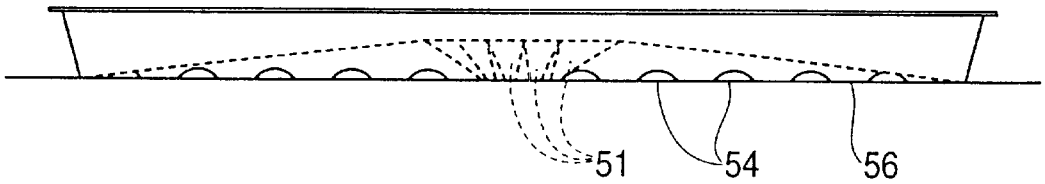
FIG. 10 shows a side elevational view through the packing item shown in FIG. 9 according to the invention.

The packing item 44 shown in FIGS. 9 and 10 is intended for a divisible pizza, i.e. for use in cases where only a part of a pizza is to be baked in a microwave oven. The packing item 44 has three radial perforations 46 which from outer edge incisions 48 extend inward to a specially designed central area 50. This is designed within a circular edge 52 with downward bent, sloping "feet" 51 which, when the packing item 44 including pizza has been divided, serve as support for the pointed end (FIG. 10) of the divided packing item 44 so that there is still achieved optimum ventilation under the divided packing item 44. It has been difficult to make the radial perforations 46 without having tendency to break up before time. In that connection it is advantageous to emboss radial bending lines 53 at first so that the material is stretched or pre-stressed, which appears to solve the problem of the perforations 46 breaking up before time.

As shown in FIG. 10, the outer support edge of the packing item 44 also has radial ventilation openings 54 and feet 56, respectively. The packing item 44 is designed with radial ventilation openings in the bottom surface of the same kind as by the packing item 30, cf. FIG. 6, but as shown with stippled line. The packing item 44 may also be provided with circular ventilation openings or possibly be provided with a combination of the shown types of ventilation openings.

FIG. 11 illustrates how the ventilation openings in the bottom part of the packing item may be designed in different ways, for example as simple ventilation openings 8, 34. At 58 is seen a ventilation opening formed by designing a cut shown as solid lines 60, after which the flap 61 formed thereby is swung downward about the bending line 62 so that the downward facing free edge of the flap 61 may serve as support for the bottom surface of the packing item. A similar principle is used at 63 where a T-shaped cutting is performed after which the two flaps formed thereby may be bent downwards and used as partial support feet for the bottom surface.

By 64, 65 and 66 illustrate a sawtooth, wavy, or rectangular curve cutting for forming two flaps which subsequently may be swung downwards about the bending lines. By using such irregular cutting lines there is achieved the further effect that the ventilation along the underside of the packing item takes place more diffusely, in contrast to forming relatively close radial ventilation ducts between the turn down flaps. In that connection, it may furthermore be an advantage that absorbing edge parts of the material of the packing item become exposed so that the material itself contributes to removing excessive humidity from e.g. a pizza. Such an absorbing effect from exposed material edges has of course an enhanced effect if the packing item, for example, is made of paper pulp provided with susceptor and surface coating.

Preferably, the packing item according to the invention is made of a material which at one side is provided with susceptor coating everywhere, but for application to some dough items, e.g. pies, it may be an advantage that upright, annular edge areas of the packing item do not have susceptor coating.

Furthermore, it should be emphasized that the packing item according to the invention makes possible to complete packing of raw dough items, e.g. pizza with filling, which immediately after production are packed in the packing item and frozen for storing as frozen goods. In this situation of use, the packing item with the pizza is put directly into a microwave oven for baking for serving. In other words, it becomes possible to make pizzas with filling without having a production oven, something which in reality is a remarkable simplification.

Finally it shall be mentioned that the ventilation openings in the susceptor coated support surface of a packing of the invention may be combined with known box packings for pizzas or other dough items where an outer side of the box is provided with a susceptor coating. The intention is to take the pizza out of the box and place it upon the susceptor coating of the box so that hereby good ventilation under the pizza is established. In order to further optimize ventilation, the susceptor coating of the invention may furthermore be provided with ventilation openings or designed with prepared perforated fields intended to be pressed out when the susceptor coating of the box is used as an elevated baking underlay for a pizza or another dough item in a microwave oven.

Another possibility in accordance with the invention is that a box packing for a pizza or other dough item inside the bottom surface is designed with a field provided with susceptor coating and which is prepared to be pressed out, as the intention is to press the susceptor field out so that an opening is created in the bottom of the box. This is then turned so that the bottom of the box with the opening faces upwards, after which the pressed out susceptor field, which, for example, may be triangular, is placed upon the opening in a turned condition, i.e. so that the susceptor field does not fall through openings which have the same shape. The susceptor field may furthermore be designed with advantage with a number of ventilation openings which e.g. may be formed by pressing out prepared, perforated openings.

What is claimed is:

1. A microwave packing item for containing a prebaked or frozen dough item comprising:

a bottom, including a top side which is flat and for contacting the dough item and is coated with a polyester susceptor layer coated with metal and a bottom side which is separated from a support surface during cooking by at least one projection extending downward from the bottom side and ventilation openings outside a non-ventilated central area of the bottom which extend from the top side through the bottom side for providing ventilation from a bottom side of the dough item outside a central area of the dough item when facing the central area of the bottom to outside the packing item.

2. A microwave packing item in accordance with claim 1 comprising:

at least one detachable label covering the ventilation openings.

3. A microwave packing item in accordance with claim 2 comprising:

radial perforations in the bottom which are severed to divide the packing item along the radial projections; and wherein the at least one projection comprises in the central area of the bottom downwardly extending feet with pointed ends for contacting the support surface.

4. A microwave packing item in accordance with claim 2 wherein:

the packing item is part of a box for containing the dough item prior to cooking with the polyester susceptor layer being on an outside surface of the box and the ventilation openings are perforated fields which are pressed out when the dough item is cooked.

5. A microwave packing item in accordance with claim 4 wherein:

the outside surface is a top surface of the box.

6. A microwave packing item in accordance with claim 1 wherein the at least one projection comprises:

a plurality of feet.

7. A microwave packing item in accordance with claim 6 wherein:

the plurality of feet are located in a peripheral area of the bottom of the packing item.

8. A microwave packing item in accordance with claim 7 wherein:

the packing item is part of a box for containing the dough item prior to cooking with the polyester susceptor layer being on an outside surface of the box and the ventilation openings are perforated fields which are pressed out when the dough item is cooked.

9. A microwave packing item in accordance with claim 8 wherein:

the outside surface is a top surface of the box.

10. A microwave packing item in accordance with claim 6 wherein:

the plurality of feet are located inward, from a peripheral area of the bottom of the packing item, toward the central area of the bottom.

11. A microwave packing item in accordance with claim 10 wherein:

the packing item is part of a box which contains for containing the dough item prior to cooking with the polyester susceptor layer being on an outside surface of the box and the ventilation openings are perforated fields which are pressed out when the dough item is cooked.

12. A microwave packing item in accordance with claim 11 wherein:

the outside surface is a top surface of the box.

13. A microwave packing item in accordance with claim 6 comprising:

radial perforations in the bottom which are severed to divide the packing item along the radial projections.

14. A microwave packing item in accordance with claim 6 wherein:

the packing item is part of a box for containing the dough item prior to cooking with the polyester susceptor layer being on an outside surface of the box and the ventilation openings are perforated fields which are pressed out when the dough item is cooked.

15. A microwave packing item in accordance with claim 14 wherein:

the outside surface is a top surface of the box.

16. A microwave packing item in accordance with claim 1 comprising:

radial perforations in the bottom which are severed to divide the packing item along the radial projections; and wherein the at least one projection comprises in the central area of the bottom downwardly extending feet with ends for contacting the support surface.

17. A microwave packing item in accordance with claim 1 wherein:

the at least one projection spaces the bottom from the support surface by a distance within a range of 3 to 20 mm.

18. A microwave packing item in accordance with claim 1 wherein:

the packing item is part of a box for containing the dough item prior to cooking with the polyester susceptor layer being on an outside surface of the box and the ventilation openings are perforated fields which are pressed out when the dough item is cooked.

19. A microwave packing item in accordance with claim 18 wherein:

the outside surface is a top surface of the box.

* * * * *